United States Patent [19]

Constantin

[11] Patent Number: 4,690,364

[45] Date of Patent: Sep. 1, 1987

[54] WHEELCHAIR RESTRAINING DEVICE

[76] Inventor: Bruce J. Constantin, 7575 E. Industrial, Baton Rouge, La. 70805

[21] Appl. No.: 851,972

[22] Filed: Apr. 14, 1986

[51] Int. Cl.[4] ..... A47B 97/00

[52] U.S. Cl. ..... 248/503.1; 280/289 WC; 296/65 R

[58] Field of Search ..... 248/503, 503.1; 410/4, 410/7, 23, 51; 280/242 WC, 289 WC, 179 R; 297/DIG. 4; 180/326, 330; 296/63, 65 R

[56] References Cited

U.S. PATENT DOCUMENTS

| | | | |
|---|---|---|---|
| 2,818,910 | 1/1958 | Hawkins | 297/DIG. 4 X |
| 4,062,209 | 12/1977 | Downing | 410/3 X |
| 4,076,268 | 2/1978 | Hart | 296/65 R X |
| 4,265,478 | 5/1981 | Korsgaard | 296/65 R |
| 4,455,046 | 6/1984 | Linderoth | 297/DIG. 4 X |
| 4,457,551 | 7/1984 | Anthony | 410/7 X |
| 4,471,972 | 9/1984 | Young | 297/DIG. 4 X |

FOREIGN PATENT DOCUMENTS

| | | | |
|---|---|---|---|
| 2480207 | 10/1981 | France | 248/503.1 |

*Primary Examiner*—J. Franklin Foss
*Attorney, Agent, or Firm*—William David Kiesel

[57] ABSTRACT

Mechanism for locking a wheelchair in a moving vehicle is disclosed having a guide bar attachable to the wheelchair and having a vertical rod member lockably attachable to a vehicle floor mounted latch assembly for fixing the wheelchair in the desired location in the moving vehicle, but allowing for 360° rotation of the wheelchair in its fixed position.

4 Claims, 4 Drawing Figures

WHEELCHAIR RESTRAINING DEVICE

BACKGROUND OF THE INVENTION

1. Field of the Invention

This invention relates to apparatus for securing a wheelchair to a moving vehicle such as a car or van.

2. Prior Art

The difficulty of designing a mechanism for fixing a wheelchair in a moving vehicle has long plagued the industry.

One of the major problems has been designing the locking mechanism so that it meets all government safety standards. This has resulted in devices which are bulky and/or expensive. In some cases, malfunctions of the clamping member can actually break, bend or cause excess stress to the frame structure of the wheelchair. In other cases, a loss of air pressure in the wheelchair tires can result in failure of the restraining member to continue to hold the wheelchair. None of the prior art allows for a locking mechanism which allows 360° manual rotation after the wheelchair has been locked in position. This means that the person sitting in the wheelchair may have difficulty or be unable to change position to see out of a particular window.

The closest known prior art is a device having a flat plate vertically extending from the floor of the vehicle. A hole is provided near one edge of the plate to receive a mechanical latch extending down from a guide support structure attached to the bottom of the wheelchair. The guide support structure has a channel into which the flat plate passes in order to align the latch with the plate opening. However, this device does not allow for rotation of the wheelchair after it has been locked in position and provides for a dangerous vertical plate which could seriously injure anyone who fell on it.

SUMMARY OF THE INVENTION

Therefore it is an object of this invention to provide a relatively inexpensive wheelchair locking mechanism which overcomes the above described prior art problem.

Another object of this invention is to provide a wheelchair locking mechanism which allows for rotational mobility of the wheelchair even after it has been secured.

These and other objects and advantages of the invention shall become apparent from the ensuing description of the invention.

Accordingly, an apparatus for restraining a wheelchair inside a moving vehicle is provided comprising an attaching assembly having a base member fixed to the underside of the wheelchair with a vertical member extending perpendicularly downward therefrom and a locking assembly fixedly mounted at a pre-determined position on the floor of the vehicle having a locking means to receive and lock to the vertical member.

PREFERRED EMBODIMENTS OF THE INVENTION

Figure 1:
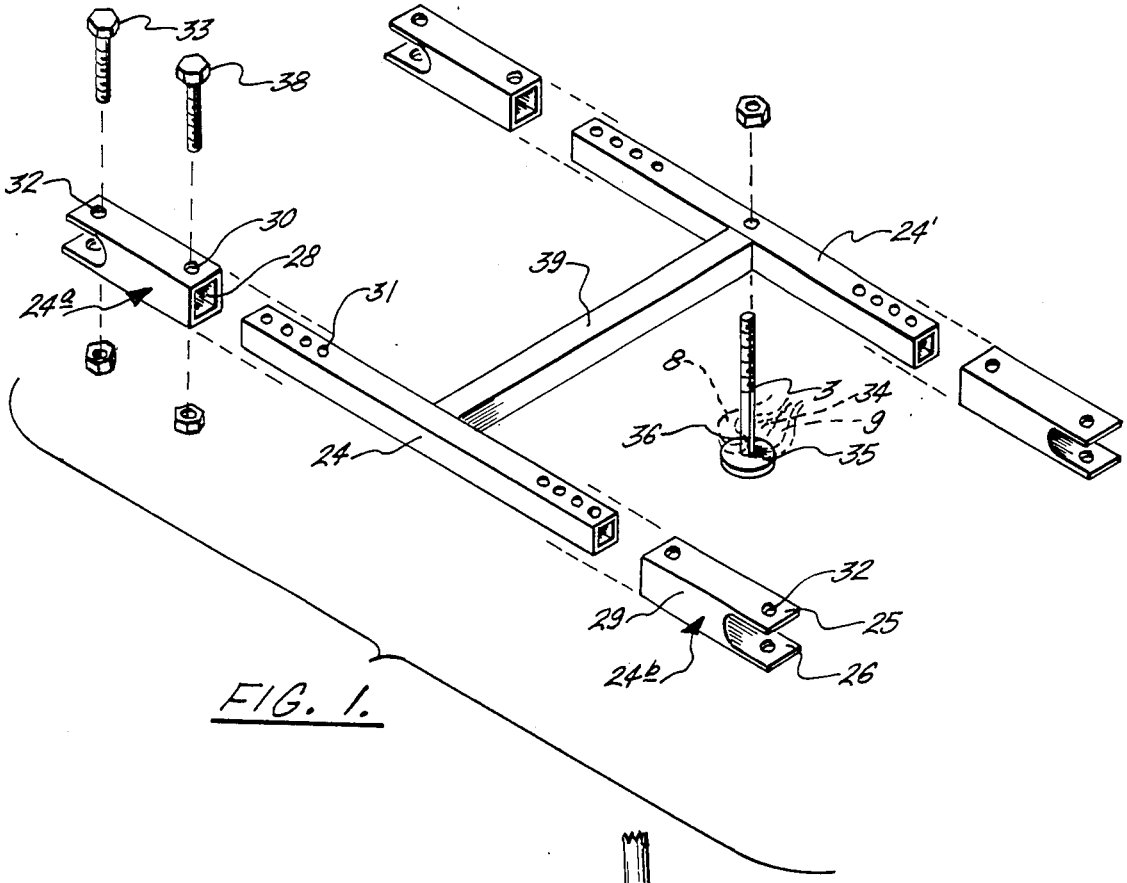
FIG. 1 is a three-dimensional view of a preferred embodiment of the invention illustrating its attachment to the floor of the vehicle and to the wheelchair.
Figure 2:
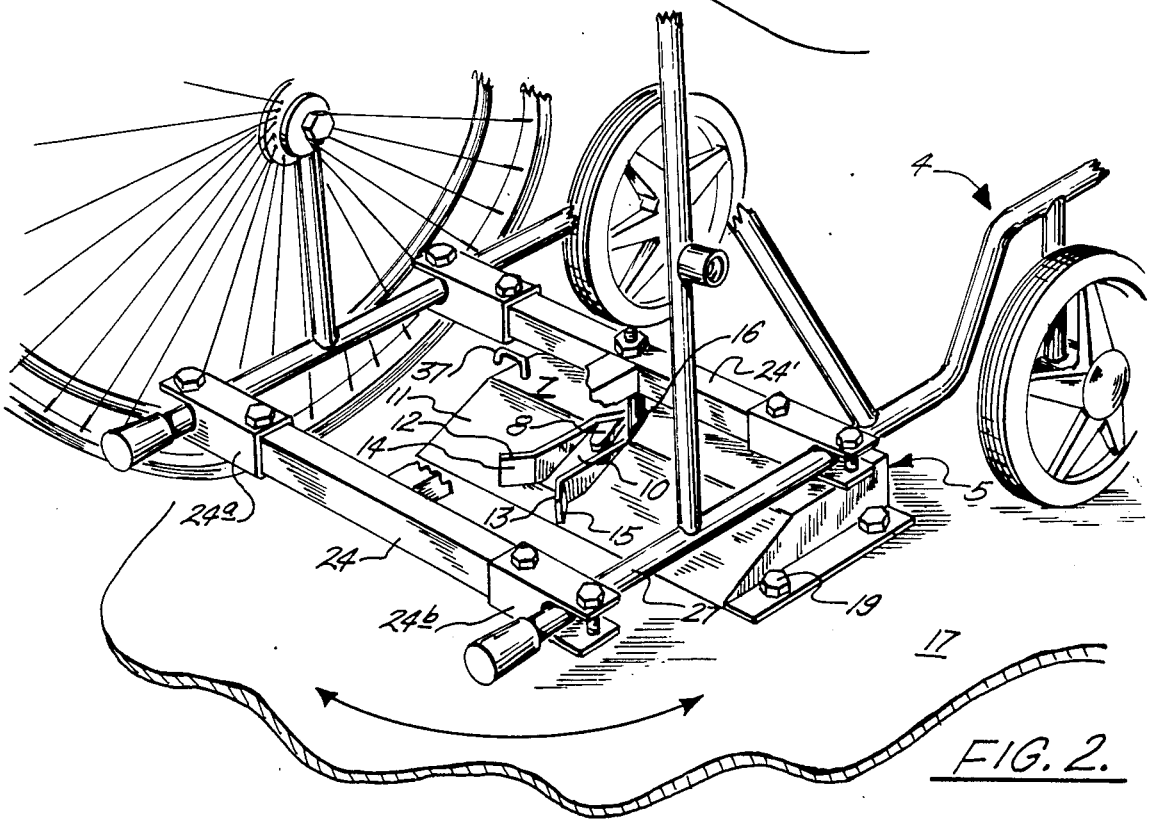
FIG. 2 is a three-dimensional view of the floor mounted locking assembly and wheelchair mounted securing member.
Figure 3:
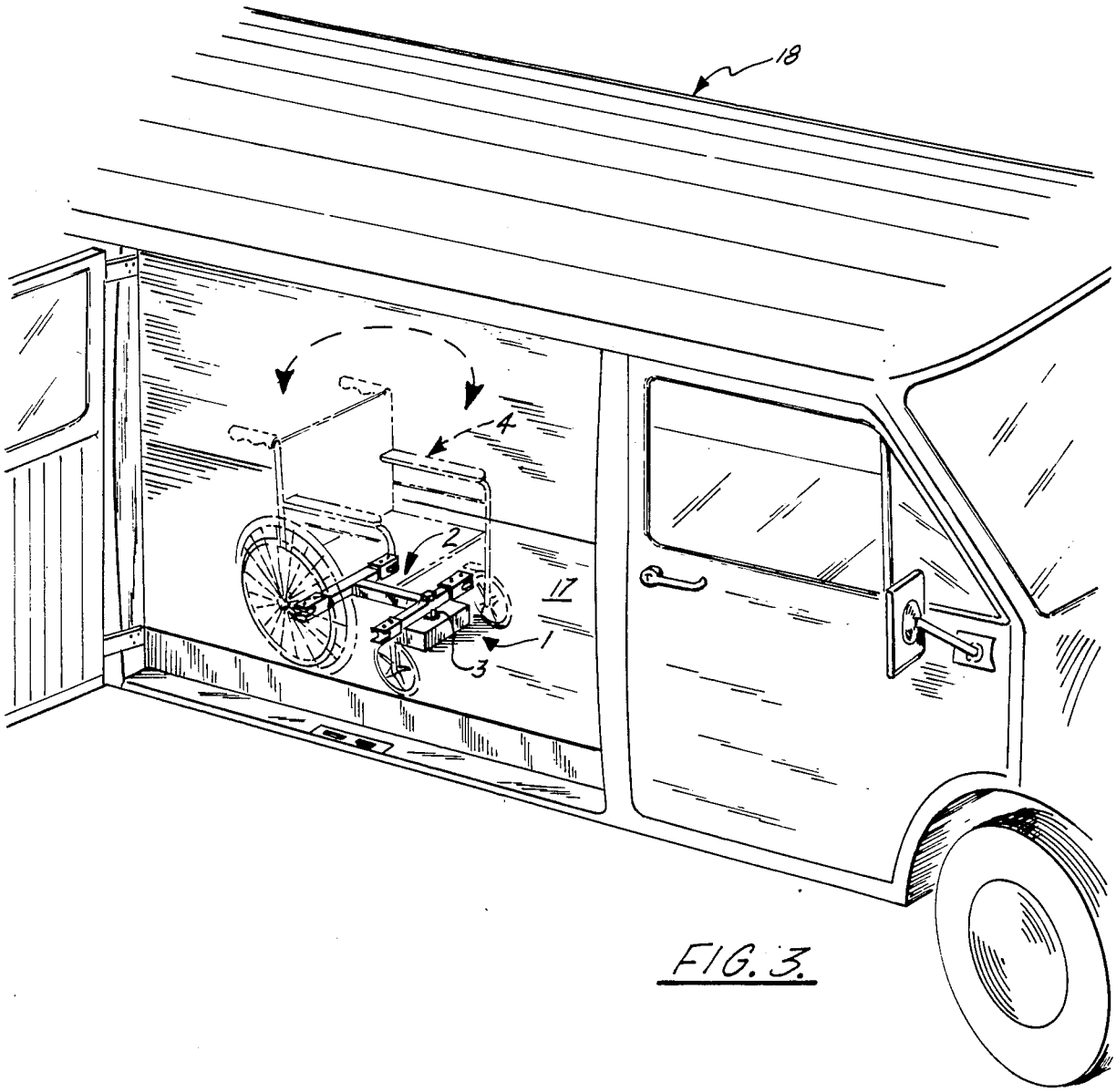
FIG. 3 is a three-dimensional view of the floor mounted locking assembly mounted on the floor of a vehicle.
Figure 4:
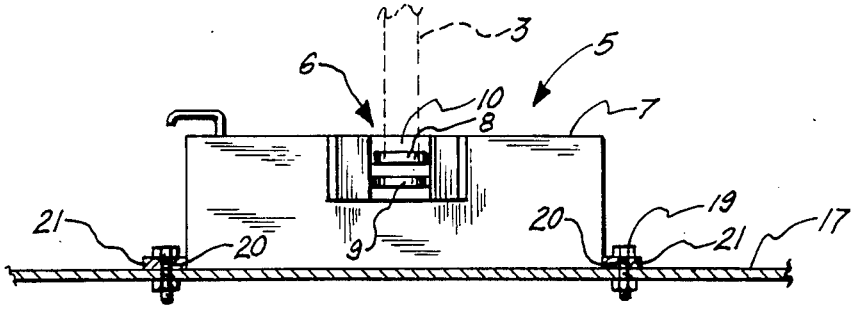
FIG. 4 is a cross-section of the vehicle floor showing the locking assembly attached to the floor.

In its broadest sense, this invention comprises a vehicle floor mounted locking assembly 1 for receiving and securing in position a vertical member 3 of an attaching assembly 2 fixedly attached to wheelchair 4.

Referring now to the figures, the locking assembly 1 preferably comprises a housing 5 in which a conventional vehicle door lock 6 is attached to upper plate 7 in a position that locking members 8 and 9, when in locking position, surround vertical member 3 and extend across guide channel 10 formed by vertical channel plate 11 having tines member 12 and 13 extending outward to receive vertical member 3 as explained below. In a preferred embodiment, tines 12 and 13 are curved outward at their protruding ends 14 and 15, respectively, to form a wider width than at the vertex area 16 of channel plate 11. In another preferred embodiment, locking members 8 and 9 are provided with conventional double lock protection by means of a two-stage, entry lock and a two-stage lock release for increased safety.

Housing 5 is mounted to the floor 17 of vehicle 18 by bolts 19 that extend through vehicle floor openings and align with bolt openings 20 in lip plate 21 that extends perpendicularly from the perimeter of housing side plate 22.

Attaching assembly 2 comprises base member 23 which is preferably bar 24 having end section 24A and 24B with spread apart end members 25 and 26 at each end that extend over and under wheelchair runners 27. In a more preferred embodiment, end section 24A and 24B comprise a hollow tube 28 whose inner channel 29 is concentric with bar 24 in order to allow easier attachment to runners 27. Tube 28 is provided with pin openings 30 positioned in alignment on opposite sides of tube 28 which can be aligned with one of a series of openings 31 on bar 24 to allow bolts 38 to pass through. In addition, tube 28 has a second pair of aligned openings 32 in each end members 25 and 24 through which bolts 33 can pass to fixedly attach bar 24 to wheelchair 4. In a preferred embodiment, end members 25 and 26 are crimped about runners 27 to permanently attach bar 24 to wheelchair 4. In a more preferred embodiment, a second bar 24' parallel to bar 24 is fixedly attached by cross bar 39 as shown and attaches to runners 27 in similar fashion as bar 24. In this embodiment, additional strength and reduction of damage to the wheelchair and the locking assembly is accomplished.

Vertical member 3 is bolted as shown or tac welded or otherwise fixedly attached to bar 24' after proper adjustment so as to extend perpendicularly downward. In a preferred embodiment, vertical member 3 will have a circular cross-section slightly smaller than opening 34 formed when locking members 8 and 9 are in a locked position to allow wheelchair 4 to pivot about the vertical member axis. In a more preferred embodiment, vertical member 3 has a stop plate 35 mounted at its lower end 36 so that stop plate 35 is positioned below locking members 8 and 9 when vertical member 3 is positioned in lock position in opening 34. This prevents the wheelchair 4 from being able to elevate, tilt or move in a vertical direction should the vehicle hit a bump or become involved in an accident.

The locking assembly 1 can be operated either electrically or mechanically by conventional means known to one skilled in the art. If operated electrically, it is preferred that a mechanical locking release assembly 37 also be attached to the locking assembly to allow unlocking in case of an electrical failure.

In operation, attaching assembly 2 is fixed to wheelchair 4 by positioning bar 24 between runners 27 and then extending end members 25 and 26 about runners 27. End members are then fixed by bolt 38 positioned in openings 30 and 31 and by bolt 33 positioned in openings 32. The wheelchair is lifted or rolled into the vehicle and aligned so that vertical member 4 travels between tines 12 and 13 until it reaches vertex area 16. Locking assembly 1 is then activated causing locking member 8 and 9 to lock in position about vertical member 4. The wheelchair can then be rotated in any position desired by the person sitting in the wheelchair or by an attendant. It is preferred that two pairs of floor-mounted seatbelts be provided at 90° to one another so that the person can be more comfortably strapped in no matter which direction the wheelchair is positioned.

There are of course other obvious embodiments not specifically described which are included within the scope of the invention as defined by the following claims.

What I claim is:

1. An apparatus for restraining a wheelchair inside a moving vehicle comprising:

(a) attaching assembly comprising:

(i) a base member fixed to the underside of said wheelchair, said base member comprising a tubular member having end pieces extendable and attachable to the parallel runners attached to wheelchair frame members underneath the seat of said wheelchair, said end pieces comprising a tubular section concentric whith said tubular member and shaped to slide along and extend beyond said tubular member, and (ii) a vertical member perpendicularly attached to said base member and extending downward; and (b) a single locking assembly fixedly mounted to a predetermined position on the floor of said moving vehicle comprising a single locking means to receive and lock to said vertical member by means to allow rotation of said vertical member while locked by said single locking means, said locking means being attached to the inside of a housing fixedly mounted to said floor, said housing having a guide channel extending along and through its top surface to receive said vertical member and position it within the locking members of said locking means.

2. An apparatus according to claim 1 wherein a stop means is positioned on said vertical member to be positioned below said locking members.

3. An apparatus according to claim 1 wherein said locking means comprises an activating assembly operatively connected to said locking members to activate said locking members to lock about said vertical member.

4. An apparatus according to claim 1 wherein a manually operated mechanical assembly having means attached to said locking means to unlock said locking members.

* * * * *